United States Patent [19]

Bleibtreu

[11] Patent Number: 4,939,319

[45] Date of Patent: Jul. 3, 1990

[54] STEP SELECTOR FOR A STEPPED TRANSFORMER

[75] Inventor: Alexander Bleibtreu, Regensburg, Fed. Rep. of Germany

[73] Assignee: Maschinenfabrik Reinhausen GmbH, Regensburg, Fed. Rep. of Germany

[21] Appl. No.: 389,429

[22] Filed: Aug. 3, 1989

[30] Foreign Application Priority Data

Aug. 12, 1988 [DE] Fed. Rep. of Germany ..... 3827386

[51] Int. Cl.[5] ..... H01H 19/54

[52] U.S. Cl. ..... 200/11 TC; 200/14

[58] Field of Search ..... 200/11 B, 11 TC, 14

[56] References Cited

U.S. PATENT DOCUMENTS 3,194,900 7/1965 Bleibtreu ..... 200/11 TC 3,366,750 1/1968 Bleibtreu ..... 200/11 TC 3,590,175 6/1971 Bleibtreu et al. ..... 200/11 TC

FOREIGN PATENT DOCUMENTS 199579 9/1958 Australia .

*Primary Examiner*—J. R. Scott

*Attorney, Agent, or Firm*—Herbert Dubno

[57] ABSTRACT

A cylindrical step selector for stepped transformer has its contact rings supported by horizontal conductors which extend out of the insulated cylinder surrounding the shaft which can displace the contact bridge along such ring and into engagement with a fixed contact. Externally of the cylinder, the conductors are aligned one above the other so as to be engageable by a pair of clamping bars which provide additional bracing. The conductors may be turned upwardly along these bars and held to the latter by straps.

6 Claims, 1 Drawing Sheet

STEP SELECTOR FOR A STEPPED TRANSFORMER

CROSS REFERENCE TO RELATED APPLICATIONS

This application is related to the commonly owned copending applications Ser. No. 07/389,423 and Ser. No. 07/389,422 filed concurrently herewith and based, respectively, on German application No. P3827388.3 of Aug. 12 1988 and No. P3829489.3 of Aug. 31 1988.

1. Field of the Invention

My present invention relates to a cylindrical step selector for a stepped transformer and, more particularly, to a step selector of the type in which a shaft lying along the axis of a cylindrical insulating support carrying respective fixed contacts in planes perpendicular to the axis, is formed with arms entraining contact bridges which engage contact rings lying in the respective planes and are engageable with the fixed contacts.

2. Background of the Invention

Austrian Patent No. 199,759 describes a step selector for a stepped transformer which comprises a shaft rotatable about an axis of the cylindrical support which is provided with the fixed contacts in respective axially spaced planes perpendicular to the axis of the shaft.

The shaft carries respective arms, each of which has, at an end thereof, a contact bridge whose inner end slidingly engages and rides along a contact ring disposed within the support and is substantially coplanar with the contact or contacts associated with the bridge. The contact rings, in turn, are nonrotatable within the support and may surround the shaft with an all-around clearance.

The contact rings themselves make an electrical connection to the transformer circuit by conductors extending through the wall of the support and can be carried, in turn, or supported within the support or wall by these conductors.

OBJECTS OF THE INVENTION

It is an object of the invention to provide an improved step selector in which the support of the contact rings is simplified by comparison to the system of the Austrian Patent but which is more secure.

Another object of this invention is to simplify the construction of the prior art step selector so that, at a reduced cost, a reliable and fixed position of the conductor and thus of the respective contact ring can be achieved.

Still another object of this invention is to provide a step selector which is more stable and reliable than prior art devices and one which is free from drawbacks of prior art systems.

SUMMARY OF THE INVENTION

These objects and others which will become more readily apparent hereinafter are attained, in accordance with the present invention in that the insulating support for the stationary contacts is constituted of a cylinder formed from an electrically insulating material. The conductors transversing the insulating cylinder wall, generally radially from the respective contact rings are oriented substantially in line with one another (i.e., are disposed one below another) externally of this wall and are engaged by a pair of clamping bars of electrically insulating material which are arranged along the outer surface of the wall of the cylinder. These clamping bars engage the horizontal portions of the conductors where they emerge from the cylinder wall and clamp these portions between them. The clamping bars are rigidly connected with the upper end and lower end of the cylinder of electrically insulating.

According to a feature of the invention, the conductors are bent through about 90° immediately beyond the clamping bars so as to run along the clamping bars. The conductors which thus extend parallel to the axis and to the clamping bars can then be attached to the clamping bar by straps or the like.

More specifically, the step selector of the invention can comprise:

- a cylindrical hollow support of electrically insulating material;
- a plurality of switching contacts in the wall in respective planes perpendicular to an axis of the support and engageable selectively to select respective stages of the transformer;
- a selector shaft rotatable about the axis in the support;
- a respective arm assigned to each of the contacts and affixed to the shaft;
- a respective stationary contact ring lying substantially in each of the planes and surrounding the shaft;
- a contact bridge on each of the arms, slidably engaging the respective ring and engageable with a respective one of the contacts;
- a respective conductor traversing the support and connected to each of the rings for supporting the rings and providing an electrical connection thereto, the conductors being generally aligned in a direction parallel to the axis and having respective portions substantially perpendicular to the axis projecting through the support and extending outwardly therefrom;
- a pair of clamping bars of electrically insulating material extending parallel to one another and generally parallel to the axis engaging the portions from opposite sides and lying generally along an outer surface of the support; and
- means for connecting the clamping bars at upper and lower ends thereof with the support.

According to a further feature of the invention, means can be provided to interconnect the bars between the generally radially portions of the conductors extending beyond the electrically insulating cylindrical wall to clamp the bars onto these portions. The bars can be channels open to one another and can have notches receiving these portions.

The advantage of the arrangement of the invention is that the engagement of the substantially horizontal parts of the ring-supporting conductors, braces the conductors with respect to one another in addition to any support provided by the wall. There is thus a plural support for each conductor. The first support is effected by the wall of the cylinder through bores of which the conductors can pass and can be snugly held. The second support is formed by the clamping bars of electrical insulating material which then engage these horizontal portions. A further support can be provided by strapping the vertical portions of these conductors to the clamping bars. This has been found to ensure a highly precise positioning of the contact rings, preventing their displacement or movement within the cylinder even where the ring cannot be supported on the shaft. The shaft can be provided with a shoulder, however, capable of providing some support for the nonrotatable ring.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
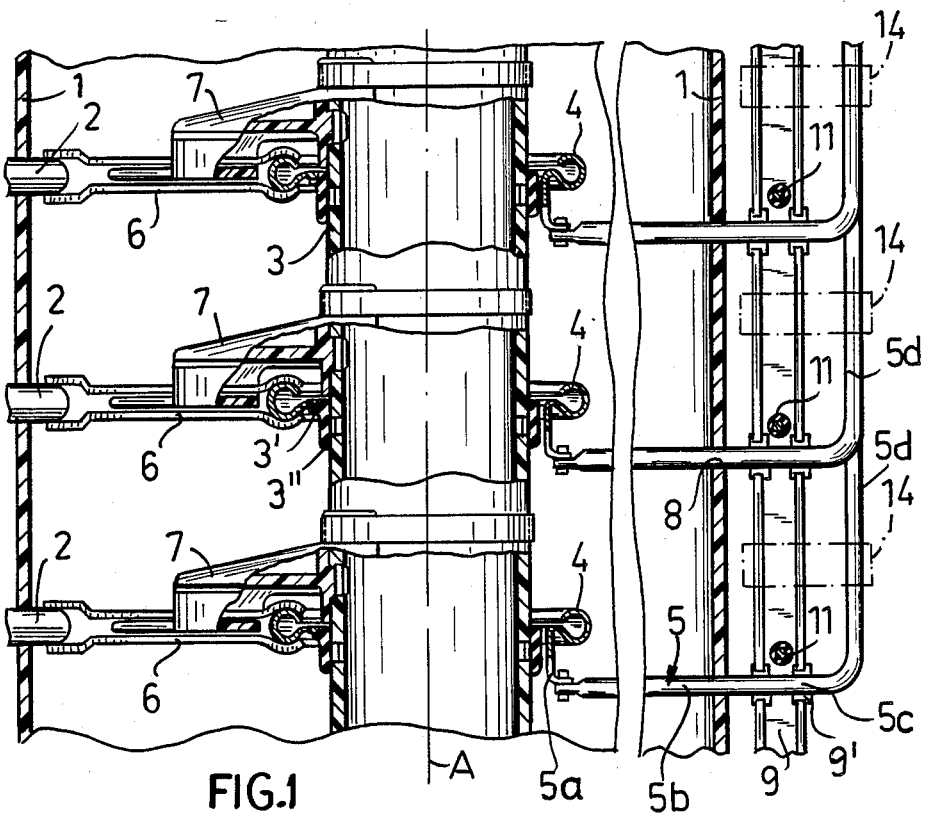
FIG. 1 is an axial cross sectional view of a step selector according to the invention showing a central portion thereof.

As can be seen from FIG. 1, the step selector of the invention comprises a supporting cylinder 1 of electrically insulating material in which fixed step contacts 2 are mounted at respective planes perpendicular to the plane of the axis A about which a tubular switching shaft 3 can be rotated.

The shaft 3 is journaled, e.g. via the journalling system described in the commonly assigned copending application Ser. No. 07/389,422, for stepwise annular displacement in the usual manner.

For each contact plane, a respective contact ring 4 is provided. The contact rings 4 loosely surround the switching shaft 3 and thus can surround the latter with all-around clearance. If desired, shoulders 3' formed by bands 3" of insulating material can be affixed to the shaft 3 to provide additional support for the nonrotatable ring.

Each of the contact rings 4 is in continuous engagement slidingly with a respective contact bridge 6, an inner end of which extends around the ring 4 while the outer end can engage the respective fixed contact 2. The contact bridge 6 in each of the contact planes is carried by a support arm 7 affixed to the shaft 3. The arms 7 can be mounted on the shaft 3 by the means described in the commonly assigned copending application Ser. No. 07/389,423 and the contact bridge 6 can be affixed to the arm 7 as also described in this latter application Ser. No. 07,389,423.

Each contact ring 4 is primarily supported by a respective conductor 5 which can be held in the wall of the cylinder 1 and has a horizontal portion extending generally radially and terminating at an attachment portion 5*a*.

The conductor can be a busbar of sufficient strength to stably support the contact ring in a cantilever manner. The portion 5*a* maybe a downwardly bent lug of the sheet metal from which the contact ring 4 is rolled.

In order to ensure the stability of the contact rings 4, each of the conductors 5 has a horizontal portion 5*b* extending through the bore 8 of the wall of the insulating cylinder 1 and anchored snugly therein. All of the horizontal portions 5*b* have extensions 5*c* located externally of the wall of the cylinder 1. The horizontal portions 5*b*, 5*c* are located in line with one another, vertically, i.e. are disposed one directly below the other.

Along the wall of the electrically insulating cylinder 1 and specifically along its outer surface, two clamping bars 9 and 10 of electrically insulating material are provided. These bars 9 and 10 have notches as shown diagrammatically at 9' and which engage and grip the extensions or portions 5*c* of the conductors immediately adjacent the wall 1.

Figure 3:
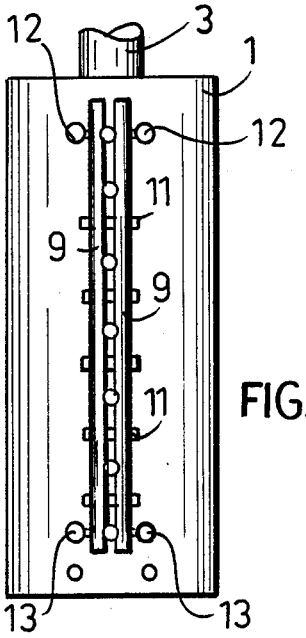
FIG. 3 is an elevational view illustrating another feature of the invention and drawn to a much smaller scale than FIGS. 1 and 2.

The clamping bars 9 and 10 are affixed at their upper and lower ends, respectively by radial posts 12 and 13 of electrically insulating material, to the cylinder 1, as can be seen in FIG. 3. Electrically insulating clamping members 11, which may be screws threaded into a connector, can draw the two bars together.

Figure 2:
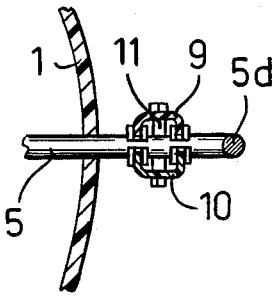
FIG. 2 is a horizontal section taken through a region of this portion.

As is apparent from FIG. 1, the conductors 5 have upwardly bent portions 5*d* shown in FIGS. 1 and 2 but broken away in FIG. 3, and which can be bundled together and tied to the clamping bars 9 and 10 by electrically insulating straps represented at 14.

As a consequence, a highly mechanically stable positioning of the rings 4 is ensured.

I claim:

1. A cylindrical step selector for a stepped transformer, comprising:

a cylindrical hollow support of electrically insulating material;

a plurality of switching contacts in a wall of said support in respective planes perpendicular to an axis of said support and engageable selectively to select respective stages of the transformer;

a selector shaft rotatable about said axis in said support;

a respective arm assigned to each of said contacts and affixed to said shaft;

a respective stationary contact ring lying substantially in each of said planes and surrounding said shaft;

a contact bridge on each of said arms, slidably engaging the respective ring and engageable with a respective one of said contacts;

a respective conductor traversing said support and connected to each of said rings for supporting said rings and providing an electrical connection thereto, said conductors being generally aligned in a direction parallel to said axis and having respective portions substantially perpendicular to said axis projecting through said support and extending outwardly therefrom;

a pair of clamping bars of electrically insulating material extending parallel to one another and generally parallel to said axis engaging said portions from opposite sides and lying generally along an outer surface of said support; and means for connecting said clamping bars at upper and lower ends thereof with said support.

2. The step selector defined in claim 1 wherein each of said portions is connected to a further conductor part bent at substantially 90° to the respective portion and extending generally parallel to said axis and said bars.

3. The step selector defined in claim 2 wherein said parts extend along said bars, further comprising means for strapping said parts to said bars.

4. The step selector defined in claim 3, further comprising means interconnecting said bars between said portions to clamp said bars onto said portions.

5. The step selector defined in claim 4 wherein said bars are channels open toward one another.

6. The step selector defined in claim 5 wherein said channels have notches receiving said portions.

* * * * *